US006999031B2

(12) United States Patent
Berezin et al.

(10) Patent No.: US 6,999,031 B2
(45) Date of Patent: Feb. 14, 2006

(54) ANTENNA DEVICE AND ITS USE IN A COMMUNICATION DEVICE

(75) Inventors: Maksim Berezin, Netanya (IL); Motti Elkobi, Netanya (IL)

(73) Assignee: Motorola, Inc., Schaumburg, IL (US)

( * ) Notice: Subject to any disclaimer, the term of this patent is extended or adjusted under 35 U.S.C. 154(b) by 62 days.

(21) Appl. No.: 10/669,239

(22) Filed: Sep. 24, 2003

(65) Prior Publication Data

US 2005/0062671 A1 Mar. 24, 2005

(51) Int. Cl.
*H01Q 1/24* (2006.01)

(52) U.S. Cl. ..... 343/702; 343/846

(58) Field of Classification Search ..... 343/833, 343/834, 700 MS, 702, 829, 846; 455/575.7
See application file for complete search history.

(56) References Cited

U.S. PATENT DOCUMENTS 6,107,970 A * 8/2000 Holshouser et al. ..... 343/702
6,765,536 B1 * 7/2004 Phillips et al. ..... 343/702

* cited by examiner

*Primary Examiner*—Michael C. Wimer
(74) *Attorney, Agent, or Firm*—Valerie M. Davis

(57) ABSTRACT

An antenna device (2) includes a conducting base (3), an elongate conducting element (7) coupled to and extending from the conducting base and a parasitic conductor (9) connected to and extending from the conducting base. The device is configured to provide in operation in a plurality of frequency bands omnidirectional radiation patterns in two mutually orthogonal planes (x-y; x-z). The radiation of these patterns may conveniently have the same polarization.

22 Claims, 9 Drawing Sheets

ANTENNA DEVICE AND ITS USE IN A COMMUNICATION DEVICE

FIELD OF THE INVENTION

This invention relates to an antenna device and its use in a communication device. In particular, the invention relates to an antenna device for use at different operating frequencies in a communications handset especially for communication in a system having a pre-defined signal polarization, e.g. data communication in a GPRS system.

BACKGROUND OF THE INVENTION

Mobile communications are carried out using mobile radio communications units or handsets known in the art as 'mobile stations' which include a transmitter to convert messages or information input by a user into radio frequency (RF) signals for transmission to a distant receiver, and a receiver to convert received RF signals from a distant transmitter back into information which can be understood by the user. Many components of the transmitter and receiver are common components usually forming a single transceiver unit.

In a mobile station, the function of sending and receiving an RF signal via an air interface to and from a distant transceiver is carried out by a component referred to in the art as an antenna or aerial. In general, an antenna is a device which converts an electrical signal oscillating at RF frequency into a radiated electromagnetic energy signal and vice versa. In this specification, 'RF' is generally understood to mean wireless frequencies of greater than 2 kHz, e.g. up to 300 GHz. In many cases the RF energy will have a frequency of from 100 KHz to 100 GHz.

SUMMARY OF THE INVENTION

In accordance with a first aspect of the present invention, there is provided an antenna device including a conducting base, an elongate conducting element electromagnetically coupled to and extending from the conducting base, and a parasitic conductor electrically connected to and extending from the conducting base, wherein the conducting element, the parasitic conductor and the conducting base are mutually configured to provide conducting surfaces in which RF electrical currents can flow with RF frequencies in a plurality of frequency bands to provide omnidirectional radiation patterns in two mutually orthogonal planes. The RF signal radiated in these patterns can have a polarization component which is substantially the same for the patterns.

In an embodiment of the invention, the conducting element and the parasitic conductor are in substantially parallel planes. They may be provided on opposite parallel surfaces of an insulating substrate. The substrate may for example comprise a substantially planar insulating board, for example of a kind used in the production of printed circuit boards.

In an embodiment of the invention, the conducting element and the parasitic conductor are shaped metallic strips or microstrips, e.g. of copper or other conductive material employed in the art, deposited on the surfaces of such a board, e.g. using a deposition process as used for the deposition of metallized portions on a board in the production of printed circuit boards.

The conducting element and the parasitic conductor preferably have lengths which in operation provide the conducting element with an effective electrical length which is about twice that of the parasitic conductor. The conducting element may comprise an elongate strip, e.g. a microstrip, having a first portion extending along a first axis away from the conducting base and the parasitic element may comprise a shaped strip extending along an axis substantially parallel with the first axis. The conducting element may also include a second portion extending along a second axis, and an angled bend, e.g. a right angled bend, between the first and second portions, e.g. so that the first and second axes are mutually perpendicular. The second portion conveniently extends along an axis parallel with an edge of the base between major surfaces of the base.

In an embodiment of the invention, the parasitic conductor comprises a strip having a shape including on a first side an edge having a curved recess and on a second side an edge sloping toward the first side.

In an embodiment of the invention, the base comprises a conducting block, e.g. a rectangular block or chassis. The conducting element and the parasitic conductor may extend from the block in a corner region of the block. The parasitic conductor conveniently includes a tab which extends adjacent to a major surface of the block. The tab is secured to the block to provide electrical contact to the block.

The antenna device is in use fitted for operation within a mobile station such as a communications handset. The handset will include a RF transmitter and receiver, which may conveniently have common parts forming a transceiver. RF signals to be transmitted by and received by the antenna device may be fed between the antenna and the RF transceiver via a co-axial cable (e.g. by a connection at the conducting element, electrically insulated from ground, to the inner conductor of a co-axial cable).

According to the present invention in a second aspect there is provided a communications handset including the antenna device according to the first aspect. The handset may for example be a handset designed for operation in a GPRS communication system, e.g. to provide communication of data (e.g. text and numeric information). In an embodiment of the invention, the handset is operable to provide transmission and reception of RF signals in a pattern around each of said two mutually orthogonal axes, which may be along a length and a width respectively of a front surface of the handset.

The antenna device according to the invention beneficially provides transmission and reception of RF radiation signals which in each of two mutually orthogonal planes (which may be taken as an azimuth cut and an elevation cut) are in the form of an omnidirectional radiation pattern (i.e. a pattern with radiation in all directions in the plane) and with the same polarization, e.g. vertical polarization. Stated another way, the antenna device can be in one of two mutually orthogonal orientational positions and yet produce an omnidirectional radiation pattern with the same polarization. Such an antenna device is suitable for operation in the different frequency bands of a GPRS communication system with the handset in either an upright position or on its side (as illustrated later).

Embodiments of the present invention will now be described by way of example only, with reference to the accompanying drawings, in which:

BRIEF DESCRIPTION OF THE ACCOMPANYING DRAWINGS

DETAILED DESCRIPTION OF EMBODIMENTS OF THE INVENTION

Figure 1:
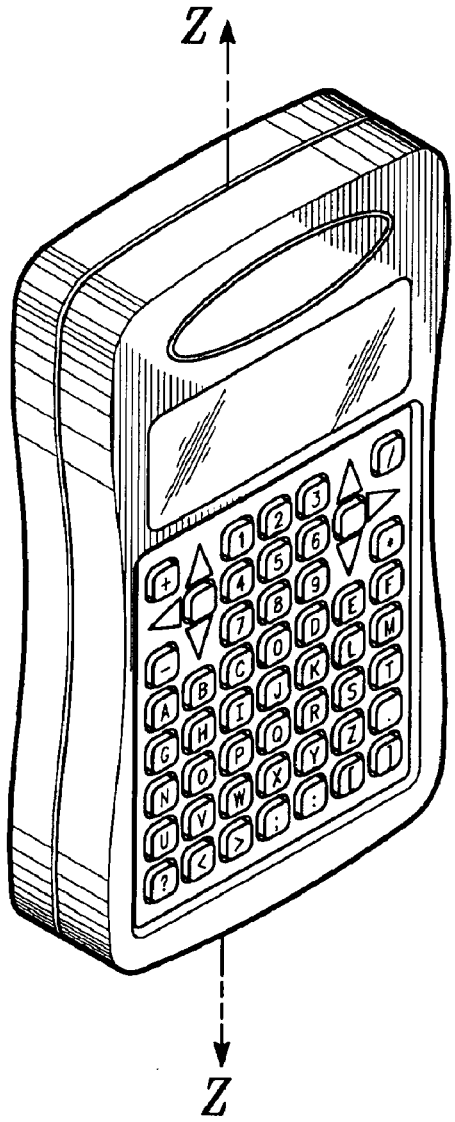
FIG. 1 is a front perspective view of a communications handset.
Figure 2:
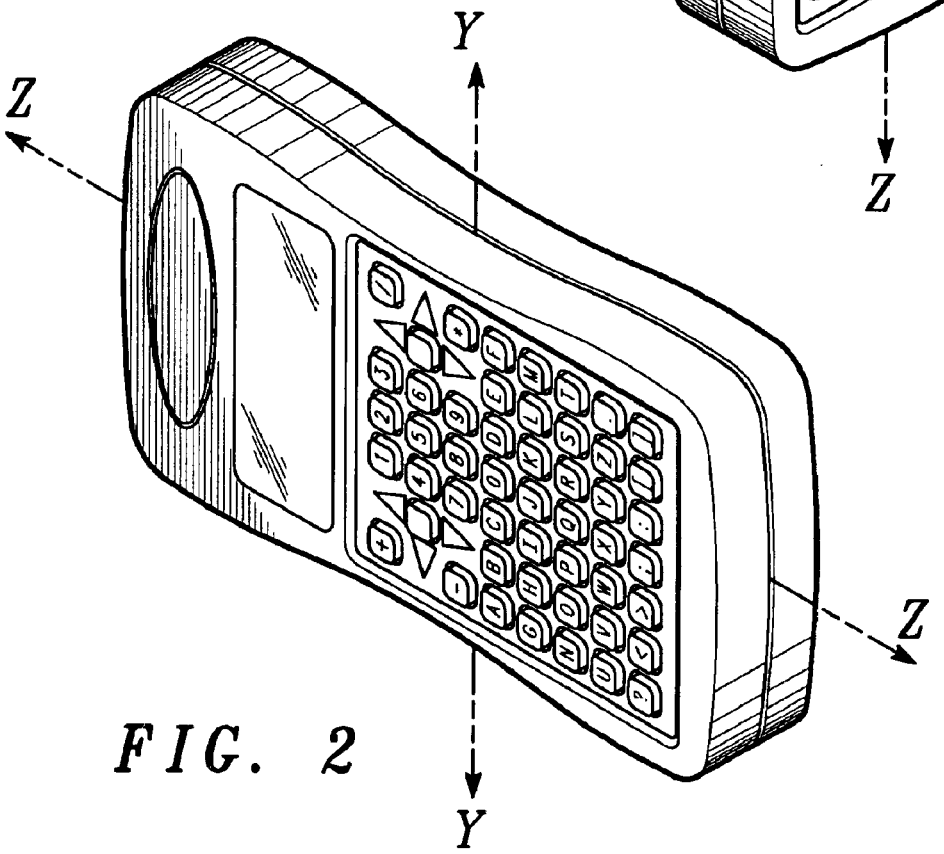
FIG. 2 is a front perspective view of the communications handset of FIG. 1 in an alternative orientation.

FIG. 1 shows a data communication handset 1 for use for example in courier services, i.e. sending and receiving data relating to package receipt and dispatch. As described later, the handset 1 is configured to transmit and receive RF wireless signals directed from or to all directions in patterns around mutually orthogonal axes with the same vertical polarization. In FIG. 1, a first of these axes, an axis z, is shown. This is an axis of symmetry of the handset 1 in a plane parallel to the front face of the handset 1 as shown running along the length of the handset 1. It is orthogonal to each of two other axes y and x (FIGS. 2 and 3) which run parallel to the width and depth respectively of the handset 1. An omnidirectional radiation pattern is to be formed in the y-z plane (i.e. the plane which includes the axis y and the axis z). An omnidirectional radiation pattern is also to be formed in the x-z plane (i.e. the plane which includes the axis x and the axis z) about the axis y, as shown in FIG. 2. Stated another way, the handset 1 is configured to transmit and receive RF radiation signals in an omnidirectional pattern (in an azimuth or horizontal cut or plane) around the same vertical axis relative to the ground—assumed to be horizontal—whether the handset 1 is in the orientation shown in FIG. 1 or that shown in FIG. 2.

Figure 3:
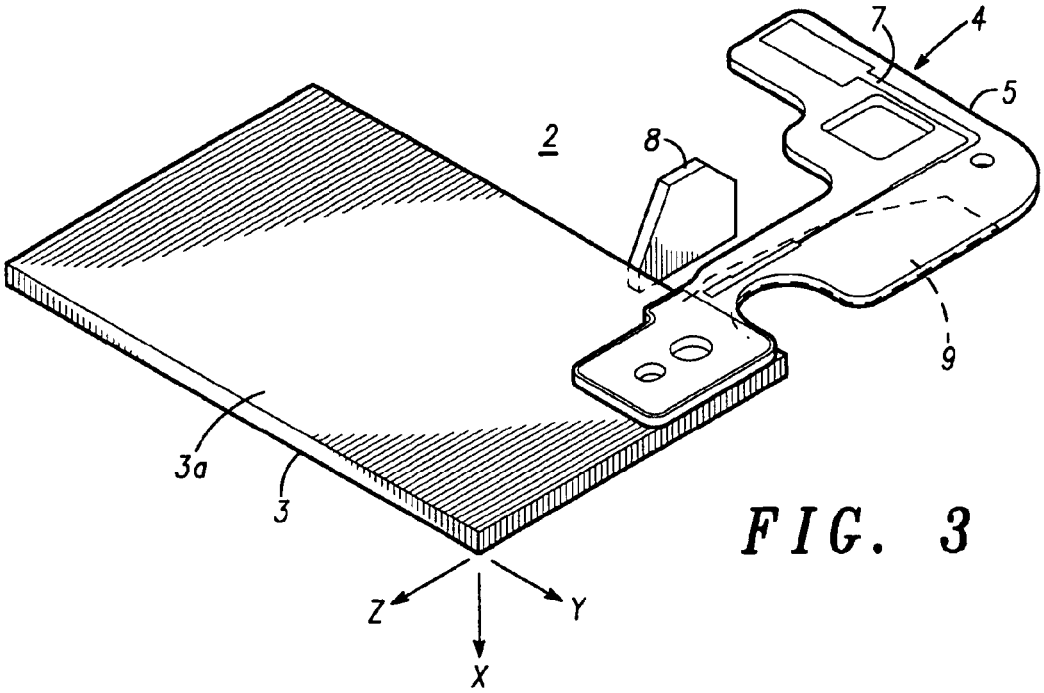
FIG. 3 is a perspective view of an antenna device employed in the handset of FIGS. 1 and 2.

FIG. 3 shows the basic elements of an antenna device 2 embodying the invention as used in the handset 1 shown in FIGS. 1 and 2. The device 2 includes as an example of the conducting base referred to in claim 1 a rectangular conducting block 3 and an antenna construction 4 whose major surfaces are coplanar with those of the block 3. The antenna construction 4 is formed on a shaped insulating board 5 which is affixed to the block 3 in one corner of its upper face (i.e. the face which is shown as uppermost in the drawing). The board 5 carries on its upper face a shaped conducting strip 7 described in more detail later, forming a monopole, and serving as an example of the elongate conducting element referred to in claim 1. The board 5 carries on its lower face (opposite to that carrying the strip 7) a shaped conducting parasitic element 9, an example of the parasitic conductor referred to in claim 1, close to part of the strip 7, described in more detail later. The mutually perpendicular axes x, y and z referred to earlier are shown in FIG. 3. These are fixed relative to construction of the antenna device 2 (and the handset 1 of FIG. 1). The axis y runs parallel to the longest side (i.e. the length) of the block 3. The axis z runs parallel to a smaller side (i.e. the width) of the block 3 at it as upper face 3*a*. The axis x runs parallel to the edges joining the upper and lower faces (i.e. the depth) of the block 3. Radiation patterns from the device 1 in relation to the axes x, y and z are illustrated later.

Attached to an edge of the block 3 is a conducting platelet 8 in a plane perpendicular to the edge of the block and perpendicular to the major surface of the block 3, i.e. in the x-z plane. The platelet 8 has a shape which approximates to a 'D' (or ear) shape with the 'straight line' of the D extending along an axis parallel to the axis z. The platelet 8 facilitates electromagnetic (non-galvanic, principally capacitive) coupling between the monopole provided by the strip 7 and the ground plane provided by the block 3.

Figure 4:
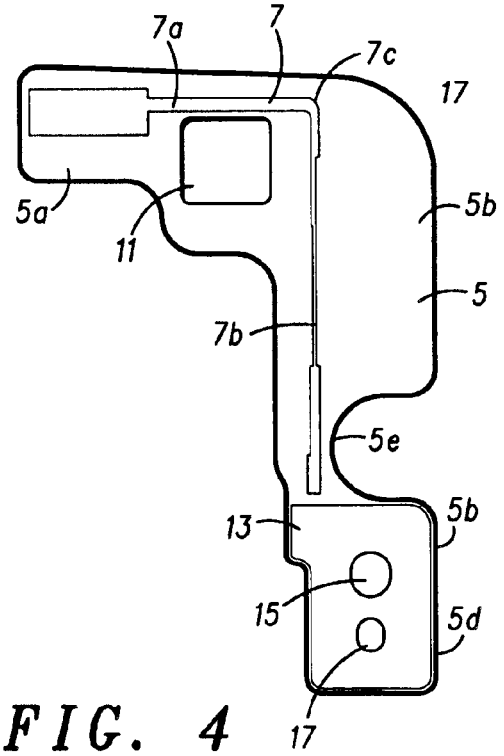
FIG. 4 is a plan view of part of the antenna device of FIG. 3 shown in more detail.
Figure 6:
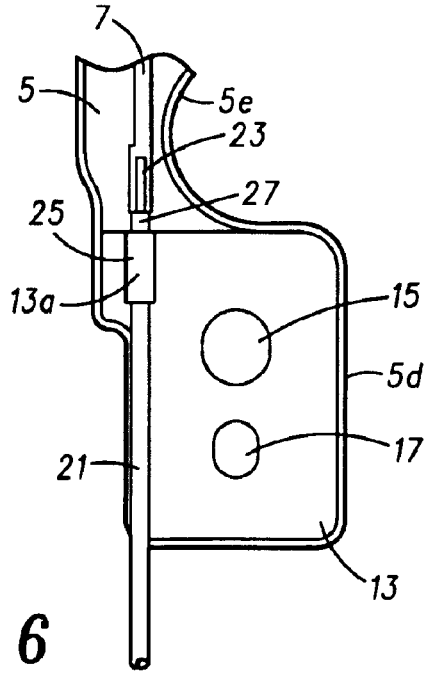
FIG. 6 is a plan view of a portion of the part shown in FIG. 4 with a co-axial cable connected thereto.

FIG. 4 shows the upper face of the board 5 and the strip 7 deposited thereon. The board 5 has an overall shape which resembles a pistol (in a two dimensional view) in that portions 5*a*, 5*b* leading to opposite ends of the board 5 point in mutually orthogonal directions. The board 5 has a hole 11 to permit location in a housing (FIG. 6). The strip 7 is deposited on the board 5 without overlapping the edges of the board 5 or the hole 11. The strip 7 has two portions 7*a* and 7*b*. Portion 7*a* is formed to extend along the portion 5*a* of the board 5 and portion 7*b* is formed to extend along the portion 5*b* of the board 5. A right angled (ninety degrees) bend 7*c* is between the portions 7*a* and 7*b* of the strip 7.

The strip 7 has various step changes in width along its length. It has six different widths in all. Its widest portion is at the end of the portion 7*a* distant from the block 3 (FIG. 2). Its narrowest portion is mid-way along the portion 7*b*. The board 5 has at the end of its portion 5*b* which is distant from the portion 5*a*, a tab 5*d* having deposited thereon a metallized pad 13. Holes 15, 17 are provided through the tab 5*d* including pad 13 by which the board 5 may be secured (by pins or bolts not shown) to the block 3 (FIG. 2) at its upper face. The board 5 has a U-shaped recess 5*e* in a region between the tab 5*d* and the remainder of the portion 5*b*, provided to define location of the board 5 into the handset 1.

Figure 5:
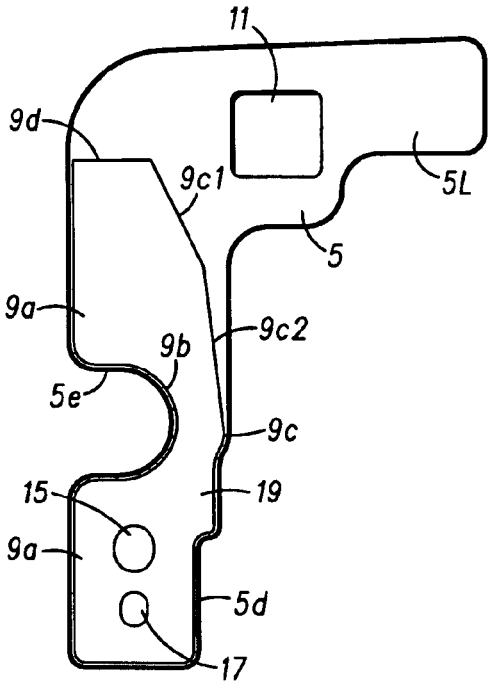
FIG. 5 is an underside view of part of the antenna device of FIG. 3 shown in more detail.

FIG. 5 shows the lower face of the board 5 with the conducting parasitic element deposited thereon. Some of the features and components shown in FIG. 3 and/or FIG. 4 are shown again in FIG. 5. The element 9 has an overall length outside the block 3 which is approximately half that of the strip 7 (FIGS. 3 and 4). The element 9 is formed to extend along the board 5 from the end of the board 5 which includes the tab 5*d*. The element 9 is deposited on the face 5L of the board 5 without overlapping the edges of the board 5. The element 9 is shaped to have on its one side 9*a* a U-shaped recess 9*b* the edge of which closely follows the edge of the recess 5*e* of the board 5. The element 9 has on its other side 9*c* (which is the side nearer the portion 7*b* of the strip 7 on the opposite face of the board 5) an edge which slopes inward toward the side 9*a* as the element extends away from the tab 5*d* toward an end 9*d*. A portion 9*c*1 near the end of the element 9 has a steeper slope than a portion 9*c*2 extending from a region of the side 9*c* level with the recess 9*b*. A metallized pad 19 is deposited on the lower face of the board 5 (i.e. the face shown in FIG. 4) near its end including the tab 5*d*.

FIG. 6 shows how RF signals are delivered to and from the strip 7. A coaxial cable 21 connected in the handset 1 to the RF section of a transceiver (not shown) has an inner conductor 23, an outer conductor 25 and an insulating sheath 27 separating the two. The inner conductor 23 is soldered to the strip 7 at its end adjacent to the recess 5*e* in the board 5. The outer conductor 25 is soldered to the metallized pad 13 (in a region 13*a*). In use the metallized pad 13 is connected to a ground plane in the handset 1 (via the pad 19 on the other face of the board 5, electrically connected to the pad 13).

Figure 7:
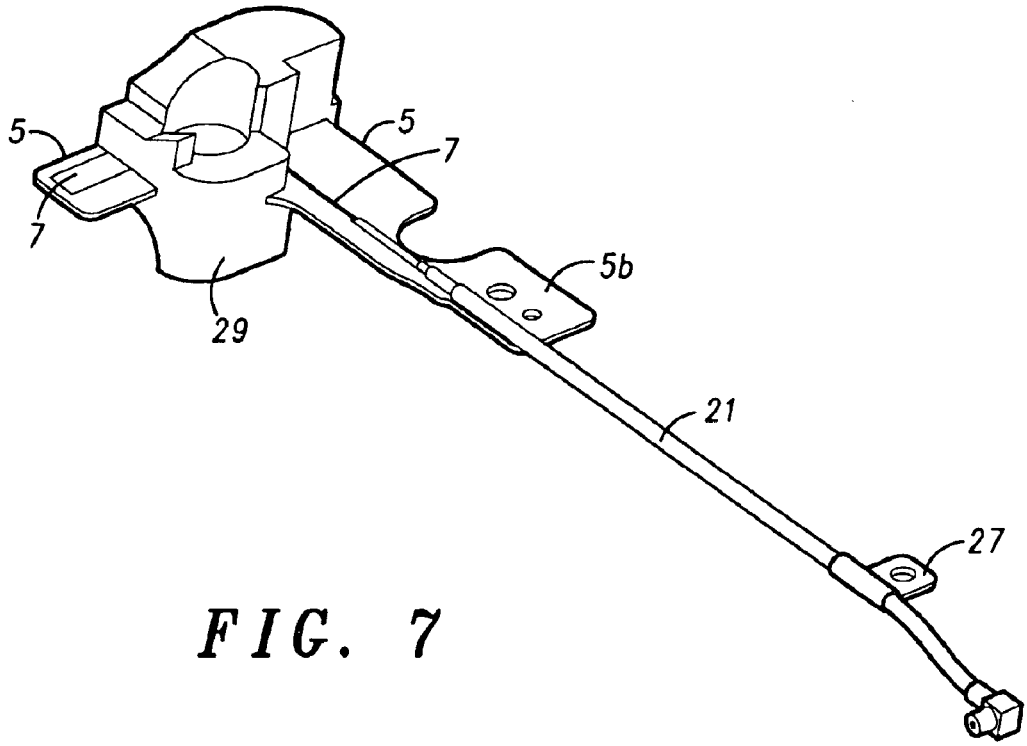
FIG. 7 is a perspective view of part of the device shown in FIGS. 3 and 5 mounted in a housing.

FIG. 7 shows the antenna construction 4 of FIGS. 3 to 5 in an assembled form. The coaxial cable 21 carries an earthing bracket 28. A plastics (e.g. molded polyurethane) housing 29 is formed around the board 5 in the region where the portions 5*a* and 5*b* thereof join. The housing 29 is mounted on a pin (not shown) fitted through the hole 11 (FIGS. 4 and 5). The housing 29 is constructed to facilitate location of the antenna construction 4 inside the handset 1 (FIG. 1) near the top end right side of the handset 1 as it appears in FIG. 1.

An example of operation of the antenna device 2 shown in FIGS. 3 to 7 where the antenna device 2 is configured for a specific application in the handset 1 is as follows.

In the particular application, the antenna device 2 is installed in the handset 1 and the handset 1 and antenna device 2 are designed to work in a GPRS (General Packet Radio Service) communication system for data communication. (This is a system which facilitates fast communication between different networks without the use of a modem). The GPRS system has three operating frequency bands: 880–960 MHz, 1710–1880 MHz and 1850–1990 MHz, and in USA there is an additional band 806–870 MHz.

The handset 1 has to transmit and receive RF radiation appropriately when it is in either (both) of the orientations shown in FIGS. 1 and 2. The handset 1 is likely to be used more often in the orientation shown in FIG. 1B than in the orientation shown in FIG. 1A.

The dimensions of the handset 1 and its internal components are already pre-defined, e.g. by user requirements, so the antenna device 2 has to fit internally within the handset 1 within a severely limited available space. The antenna device 2 allows this to be achieved.

The operational requirements of the antenna device may be summarized as follows:

1. Frequency range: 806–870 MHz, 880–960 MHz, 1710–1880 MHz and 1850–1990 MHz.
2. In the handset 1 orientation shown in FIG. 1 the antenna device 2 must provide a generally omnidirectional radiation pattern in the azimuth plane (the azimuth plane in FIGS. 1 and 2 with a constant vertical polarization (determined by GPRS use for communication with a GPRS system base station; 'vertical' here means vertical relative to the ground).
3. The VSWR for all operational bands should be less than 2.2.

Taking into account these requirements for the antenna, the antenna construction 4 is made as a printed copper microstrip (strip 7) monopole antenna on the substrate provided by the board 5. The board 5 is made from glass-epoxy composite supplied under the trade name FR-4 with a thickness t=0.8 mm. The board 5 has the strip 7 and element 9 printed in copper on its respective two faces by a known printing procedure.

Let us consider operation of the antenna device 2 at the lower frequency GPRS bands: 806–870 MHz and 880–960 MHz.

(a) For the band 806 MHz to 870 MHz:

$\lambda$ (wavelength at band centre frequency)=358 mm; $0.5\lambda$=179 mm and $0.25\lambda$=89.5 mm (b) For the band 880 MHz to 960 MHz:

$\lambda$=326 mm; $0.5\lambda$=163 mm; and $0.25\lambda$=81.5 mm.

Since these two bands are close in frequency terms, it is possible to use one antenna for operation in a combined band which embraces these two separate bands, i.e the combined band being from 806 MHz to 960 MHz. For this combined band:

$\lambda$ (wavelength at centre frequency)=339.8 mm; $0.5\lambda$=169.9 mm; and $0.25\lambda$=84.9 mm. $\Delta\lambda$ (the percentage change in wavelength across the combined band)=17.4%.

The strip 7 acting as a quarter wavelength element provides operation at this combined frequency band. In view of the limited space available, the strip 7 is bent by use of the portions 7*a* and 7*b* with a 90 degrees bend 7*c* between them. Its overall length is equivalent to an electrical length of one quarter wavelength. Because of the existence of the bend 7*c*, currents have to flow in directions parallel to the y and z axes shown in FIG. 3 in the portions 7*a* and 7*b* respectively.

The conducting platelet 8 facilitates electromagnetic (capacitive) coupling between the monopole provided by the strip 7 and the conducting ground plane provided by the block 3. This allows the combined bandwidth (measured as $\Delta\lambda$) of the monopole to be suitably increased to greater than the required figure of 17.4%. This is unusual, since usually a monopole with a large ratio L/W (where L is the monopole length and W is the monopole width) has a narrow bandwidth.

For the shape of the monopole provided by the strip 7, desirably we have also to increase the gain. The physical length of the strip 7 is less than a quarter wavelength in air for the centre frequency of the combined bandwidth. However, a shorting factor applies as the strip 7 is not infinitely thin, and is mounted on the substrate (board 5) having a permittivity $\epsilon$=4.6 and there is a capacitive coupling with the block 3 so the electrical length is effectively a quarter wavelength for the centre frequency 883 MHz.

The dimensions of the block 3 are selected as 142 mm×80 mm×17 mm. These selected dimensions, taking into account the shorting factor for this construction, are close to the dimensions required to give resonance for the combined frequency band. These 'resonance dimensions' are equivalent to satisfying $n\lambda/4$, where n=1, 2, 3, 4, 5, etc; and $\lambda$=wavelength. The location of the RF feed point and the provision of the platelet 8 together with element 9 cause RF electrical currents to flow in the block 3 with substantial components in the x-y plane.

Let us now consider the higher frequency GPRS bands having frequencies 1.71 GHz–1.88 GHz and 1.85–1.99 GHz.

The approach taken for these bands is the same as explained above for the lower frequency bands, i.e. one element is made to work for both bands in one combined band. For the combined band from 1.71 GHz to 1.99 GHz: $\lambda$ (wavelength at centre frequency)=162.2 mm; $0.5\lambda$=81.1 mm; and $0.25\lambda$=40.6 mm. $\Delta\lambda$ (the percentage change in wavelength across the combined band)=15.1%.

The strip 7 for this combined higher frequency band has a length approximately equal to a half wavelength. The dimensions of the block 3 are close to the dimensions required for the band.

On the board 5 on its lower face is the parasitic element 9. For the combined higher frequency band, this has an electrical length close to a quarter wavelength. Electrical currents in the element 9 flow in a direction parallel to the axis z in opposition to the direction of the currents in the corresponding portion, portion 7*b*, of the strip 7. For broadband matching in the higher combined frequency band, the parasitic element 9 has a specially selected shape as shown in FIG. 5, to provide a microstripline transformer, which together with the selected shape (including changing width) of the monopole provided by the strip 7 on the upper surface of the board 5 enables good matching to be achieved for these frequency bands.

On the main face (y-z plane) of the block 3; current flows with substantial components in the vertical and horizontal directions (parallel to axes y and z) for the combined higher frequency band.

Overall, these radiation patterns are provided in the required two orthogonal planes with the same required vertical polarization. These two patterns are in relation to FIG. 3 equivalent to (i) rotation of the device 2 around the axis z with polarization of the radiation signal parallel to the axis z; and (ii) rotation of the device 2 and around the axis y with polarization of the radiation signal parallel to the y axis. Stated another way, (i) is equivalent to rotation of the handset 1 in FIG. 1 around the z axis, which is the vertical axis in FIG. 1, with a signal of vertical polarization; and (ii) is equivalent to rotation of the handset 1 in FIG. 2 around the y axis, which is the vertical axis in FIG. 2, with a signal of vertical polarization.

Radiation patterns obtained for the particular form of the antenna device of FIGS. 3 to 7 having the dimensions specified earlier are shown in FIGS. 8 to 19. In FIGS. 8 to 15, the curves representing the radiation patterns have been produced using simulation software commercially available under the trade name HFSS. In FIGS. 16 to 19 actually measured radiation pattern curves are shown. In all cases (FIGS. 8 to 19) the graphs are in polar coordinates, of radiation power level, measured in dBi.

Figure 8:
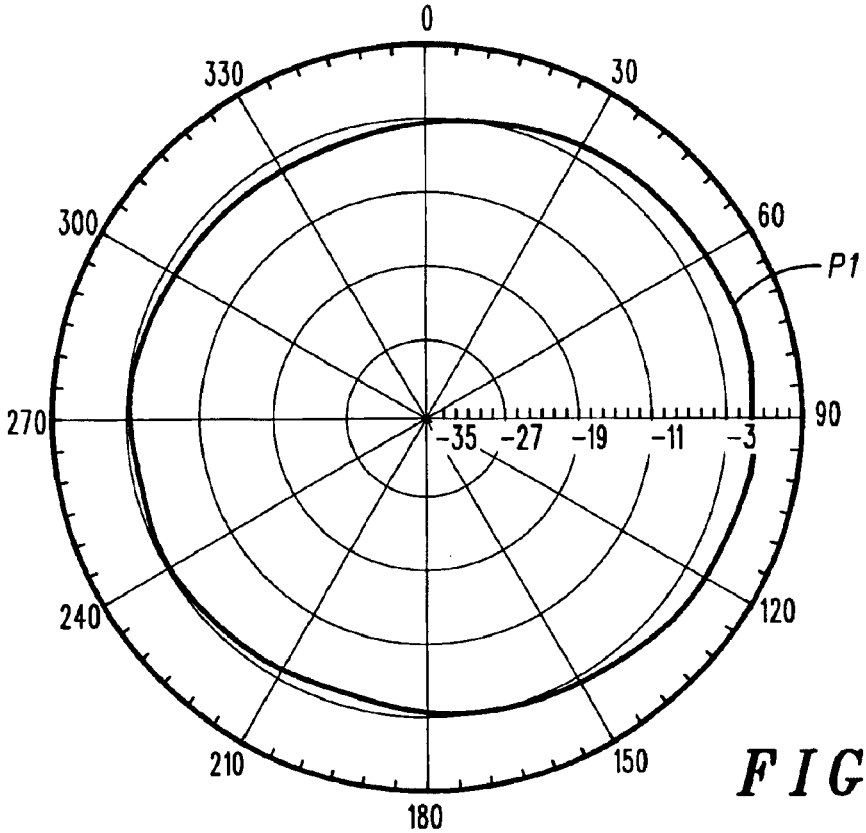
FIG. 8 is a simulation graph of the simulated RF radiation pattern obtained in azimuth cut for the handset in the orientation shown in FIG. 1 at a frequency of 832 MHz.
Figure 9:
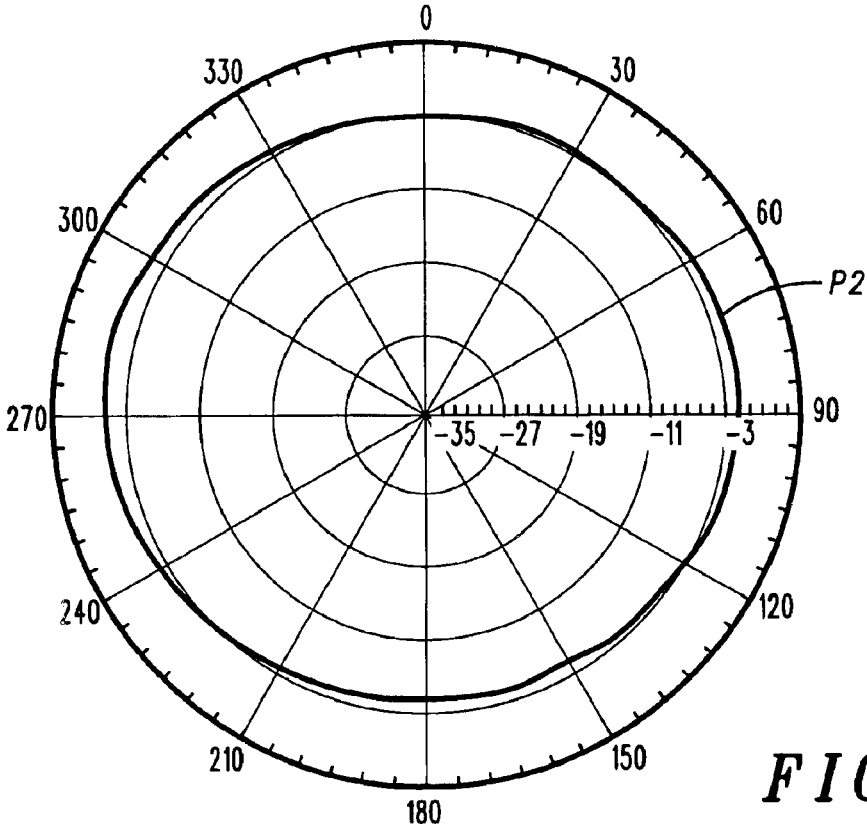
FIG. 9 is a simulation graph of the simulated RF radiation pattern obtained in azimuth cut for the handset in the orientation shown in FIG. 2 at a frequency of 832 MHz.
Figure 12:
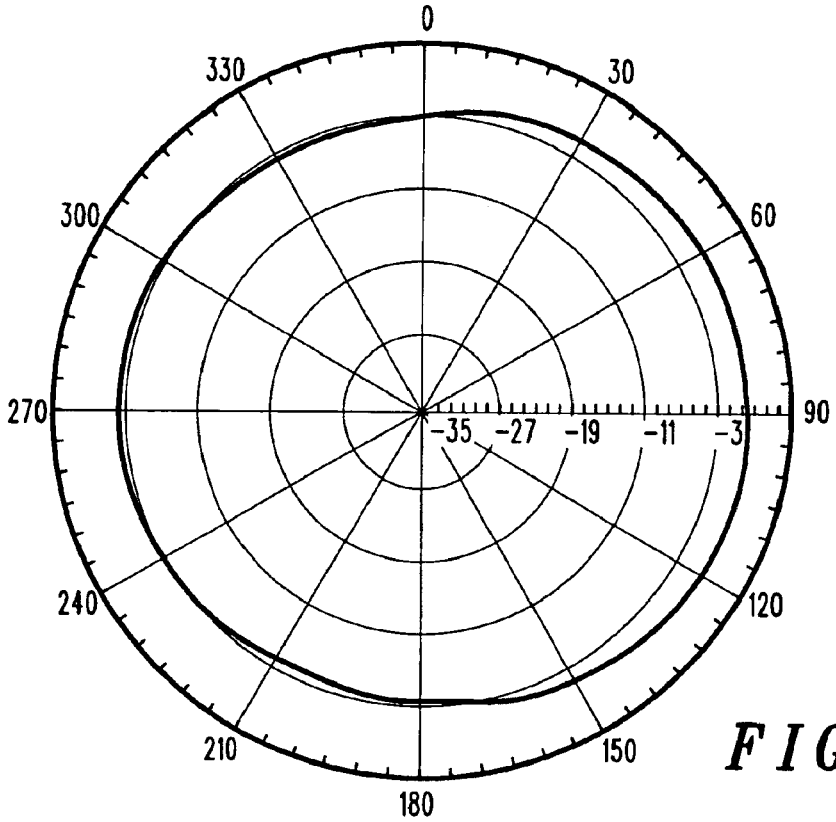
FIG. 12 is a simulation graph of the simulated RF radiation pattern in azimuth cut obtained for the handset in the orientation shown in FIG. 1 at a frequency of 0.92 GHz.
Figure 13:
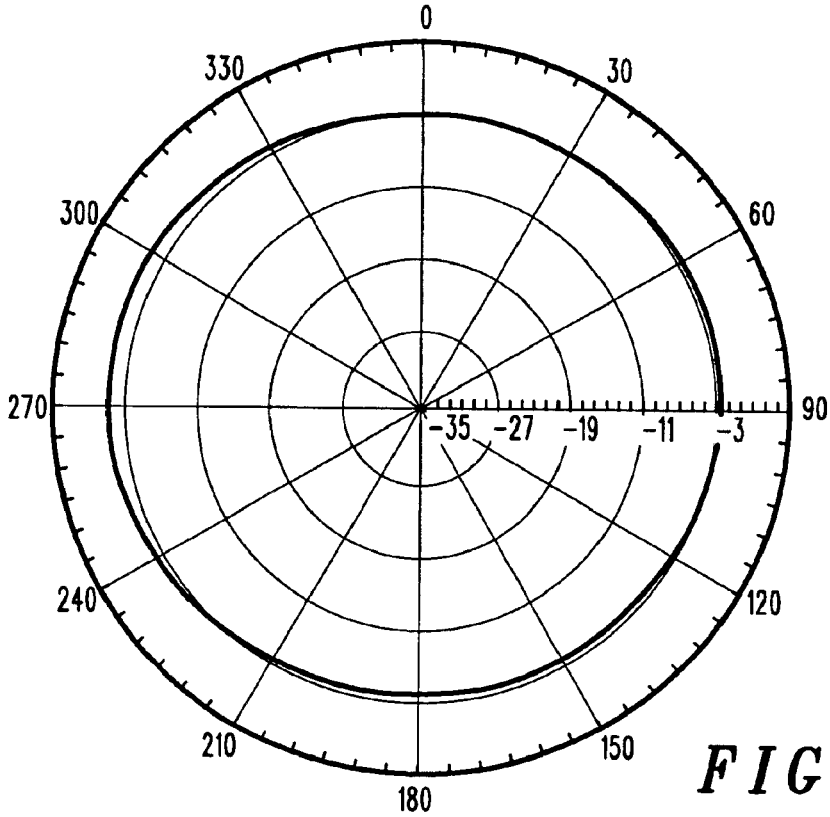
FIG. 13 is a simulation graph of the simulated RF radiation pattern in azimuth cut obtained for the handset in the orientation shown in FIG. 2 at a frequency 0.92 GHz.

FIGS. 8 and 9 show radiation patterns obtained at 832 MHz, and FIG. 12 and FIG. 13 show radiation patterns obtained at 920 MHz. The frequencies 832 MHz and 920 MHz are in the lower of the combined GPRS combined bands referred to earlier. FIG. 8 and FIG. 12 show the radiation pattern, obtained when the handset 1 is in the orientation shown in FIG. 1. The polarization of the signal in this case is mainly along the z axis shown in FIG. 1. FIG. 8 and FIG. 13 show the radiation pattern obtained when the handset 1 is in the orientation shown in FIG. 2. The polarization of the signal in this case is mainly along the y axis shown in FIG. 2. When the handset 1 is rotated from the position of FIG. 1 to that of FIG. 2, the antenna device produces a radiation pattern having suitable omnidirectional propagation in both azimuth and elevation planes with substantially linear polarization along the same axis.

Figure 10:
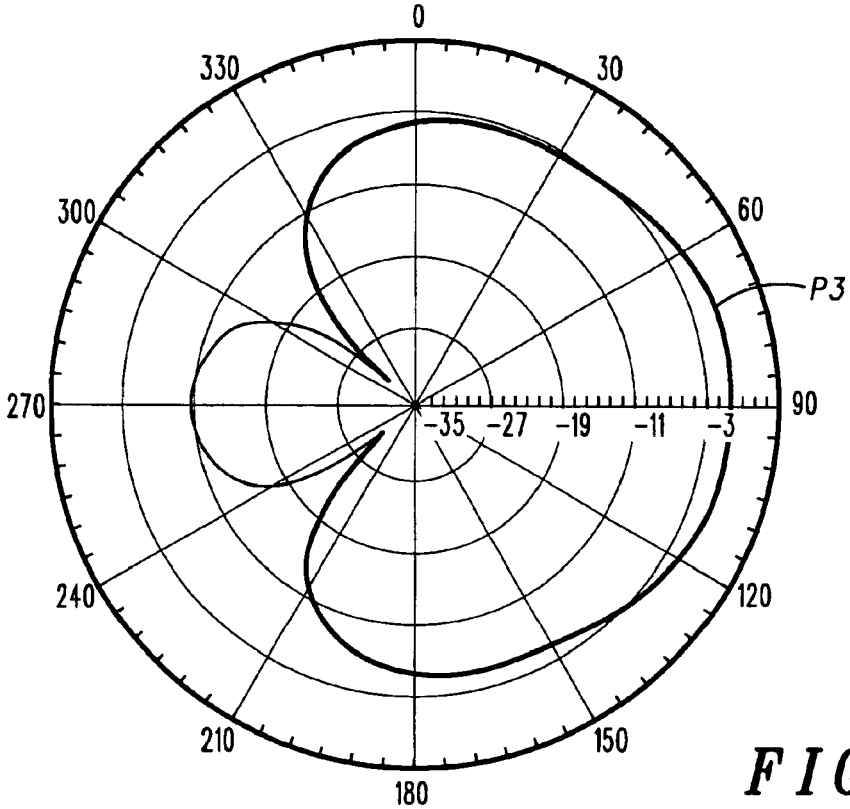
FIG. 10 is a simulation graph of the simulated RF radiation pattern obtained in azimuth cut for the handset in the orientation shown in FIG. 1 at a frequency of 1.8 GHz.
Figure 11:
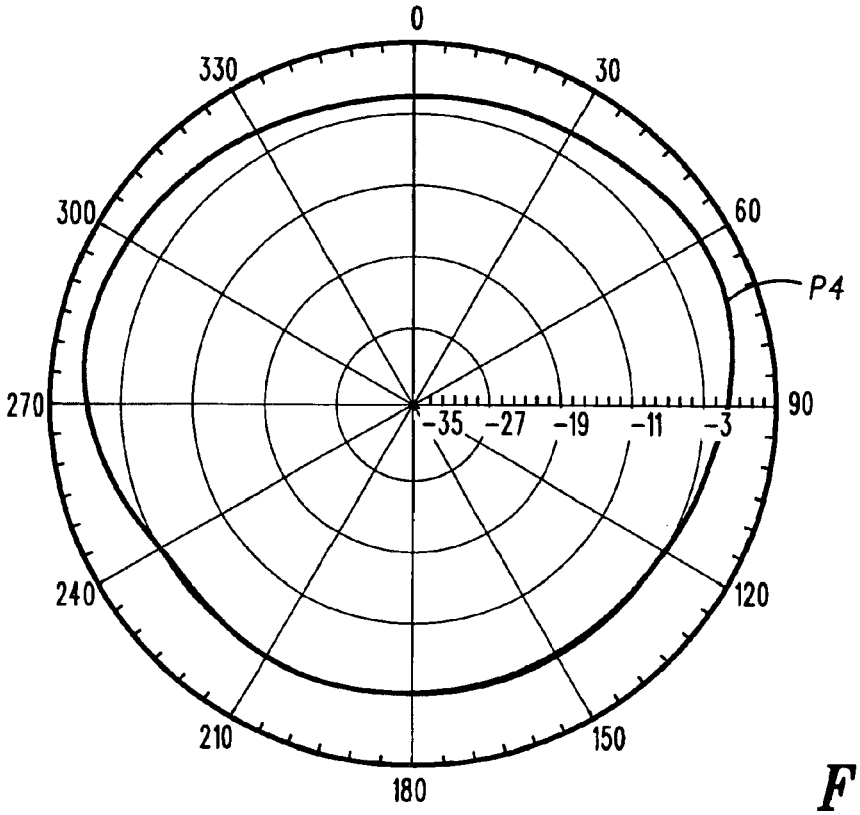
FIG. 11 is a simulation graph of the simulated RF radiation pattern obtained in azimuth cut for the handset in the orientation shown in FIG. 2 at a frequency of 1.8 GHz.
Figure 14:
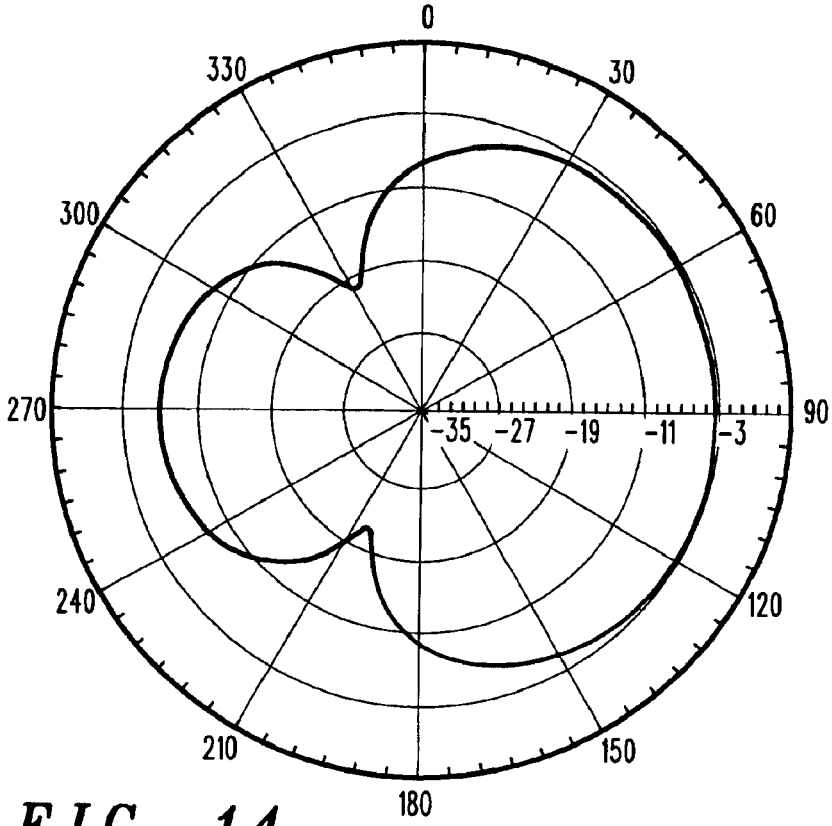
FIG. 14 is a simulation graph of the simulated RF radiation pattern in azimuth cut obtained for the handset in the orientation shown in FIG. 1 at a frequency of 1.92 GHz.
Figure 15:
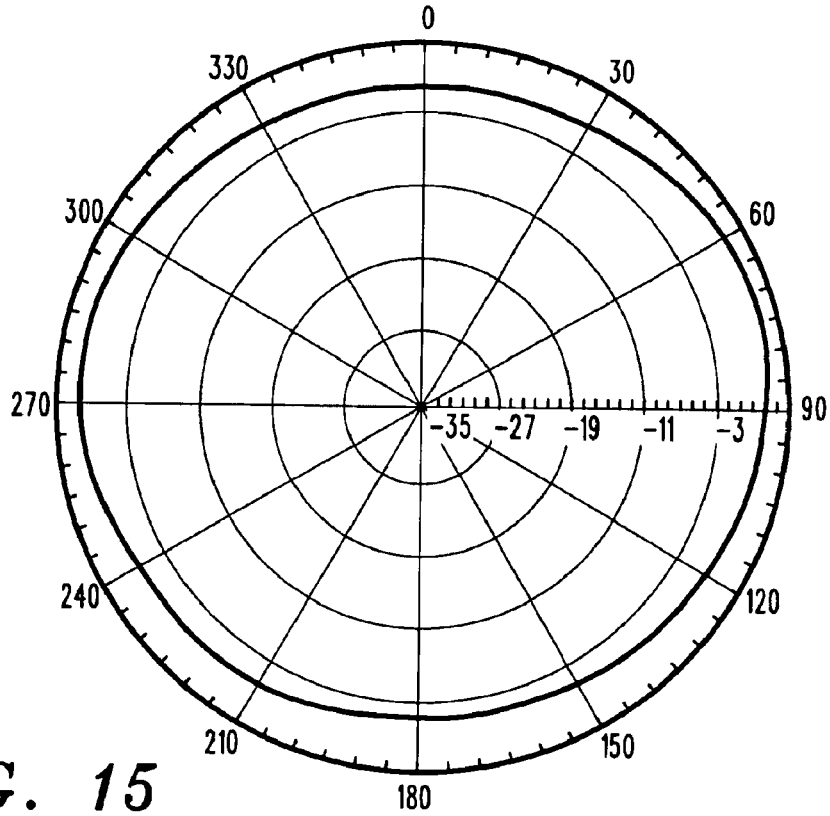
FIG. 15 is a simulation graph of the simulated RF radiation pattern obtained in azimuth cut for the handset in the orientation shown in FIG. 2 at a frequency 1.92 GHz.

FIG. 10 and FIG. 11 show radiation patterns obtained at 1.8 GHz, and FIG. 14 and FIG. 15 show radiation patterns obtained at 1.92 GHz. The frequencies 1.8 GHz and 1.92 GHz are in the higher of the combined GPRS combined bands referred to earlier. FIG. 10 and FIG. 14 show the radiation patterns obtained when the handset 1 is in the orientation shown in FIG. 1. The polarization of the signal in this case is mainly along the axis z. FIG. 11 and FIG. 15 show the radiation patterns obtained when the handset 1 is in the orientation shown in FIG. 2. The polarization of the radiation (signal) in this case is mainly along the axis y. When the handset 1 is rotated from the position of FIG. 1 to that of FIG. 2, the antenna device produces a radiation pattern having suitable omnidirectional propagation in both azimuth and elevation planes with polarization along the same vertical axis whether the handset is in the orientation shown in FIG. 1 or in that shown in FIG. 2.

Figure 16:
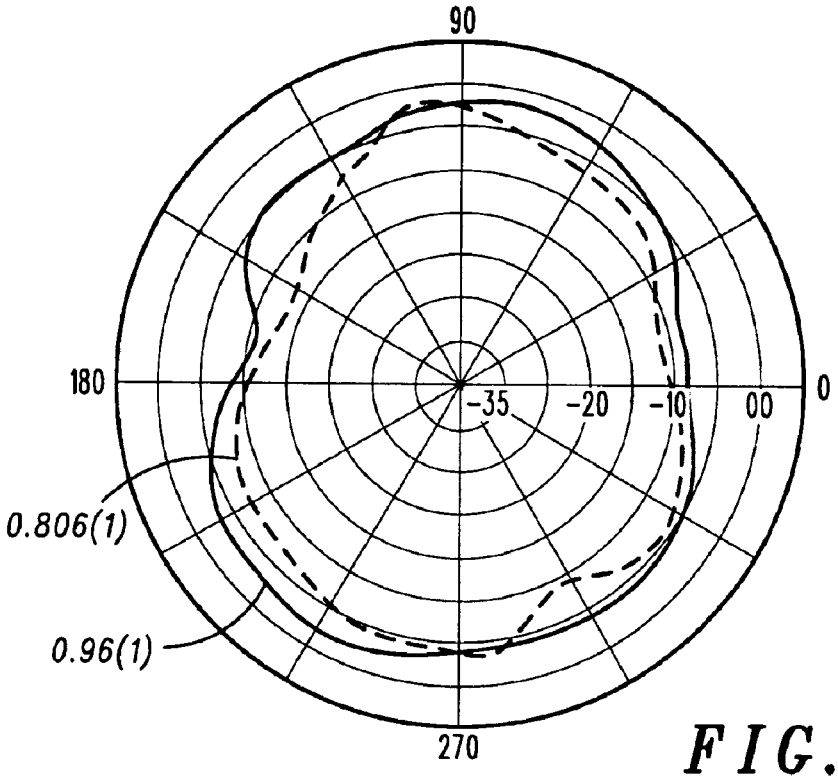
FIG. 16 is a measurement graph of actually measured RF radiation patterns obtained in azimuth cut for the handset in the orientation shown in FIG. 1 for various lower frequency bands (0.806–0.96 GHZ).
Figure 17:
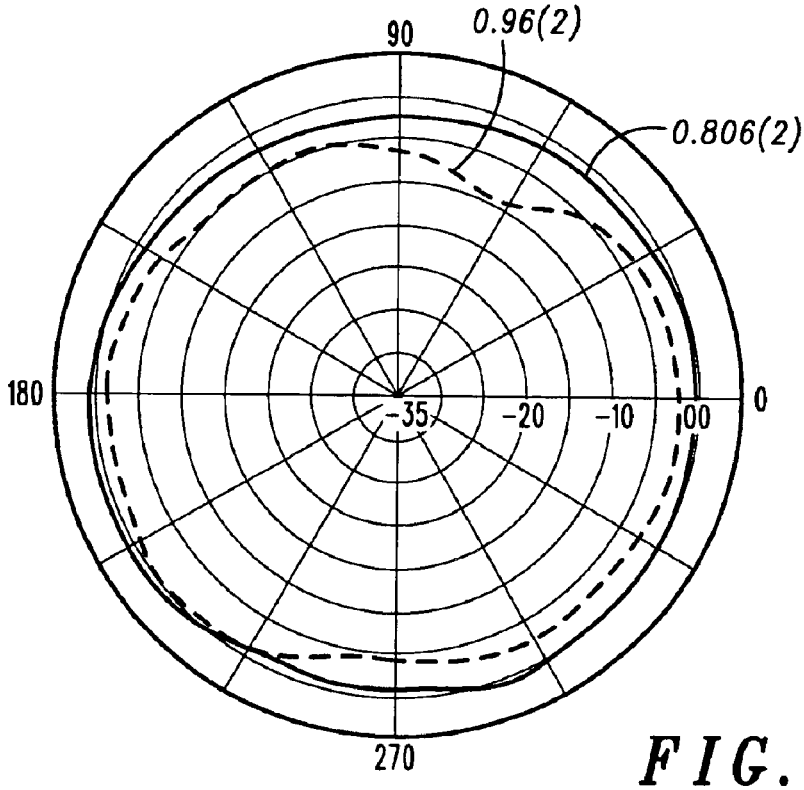
FIG. 17 is a measurement graph of actually measured RF radiation patterns obtained in azimuth cut for the handset in the orientation shown in FIG. 2 for various lower frequency bands (0.806–0.96 GHz).
Figure 18:
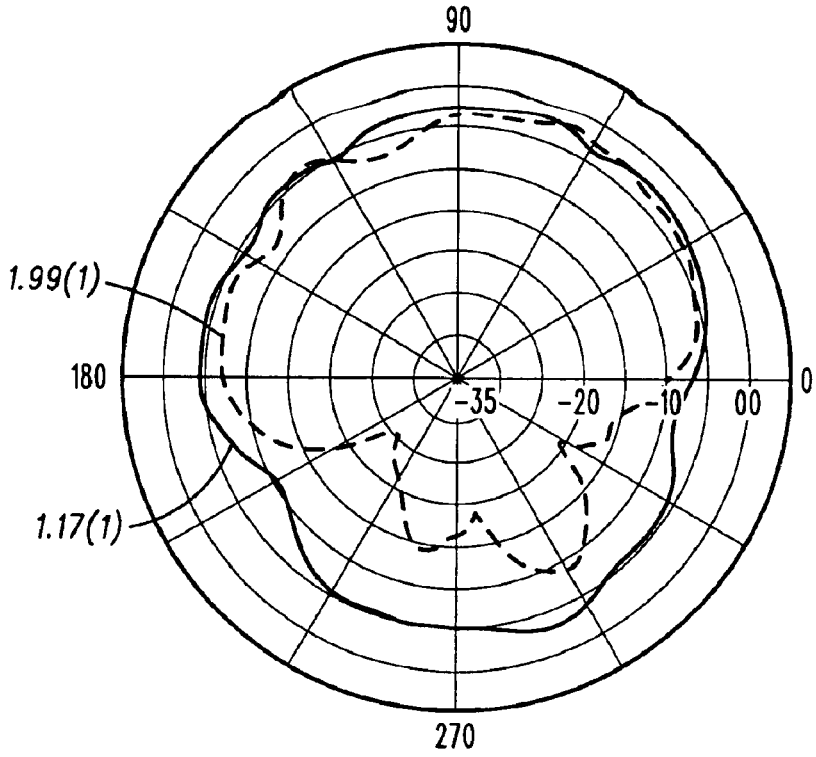
FIG. 18 is a measurement graph of actually measured RF radiation patterns obtained in azimuth cut for the handset in the orientation shown in FIG. 1 in higher frequency bands (1.71–1.99 GHz).
Figure 19:
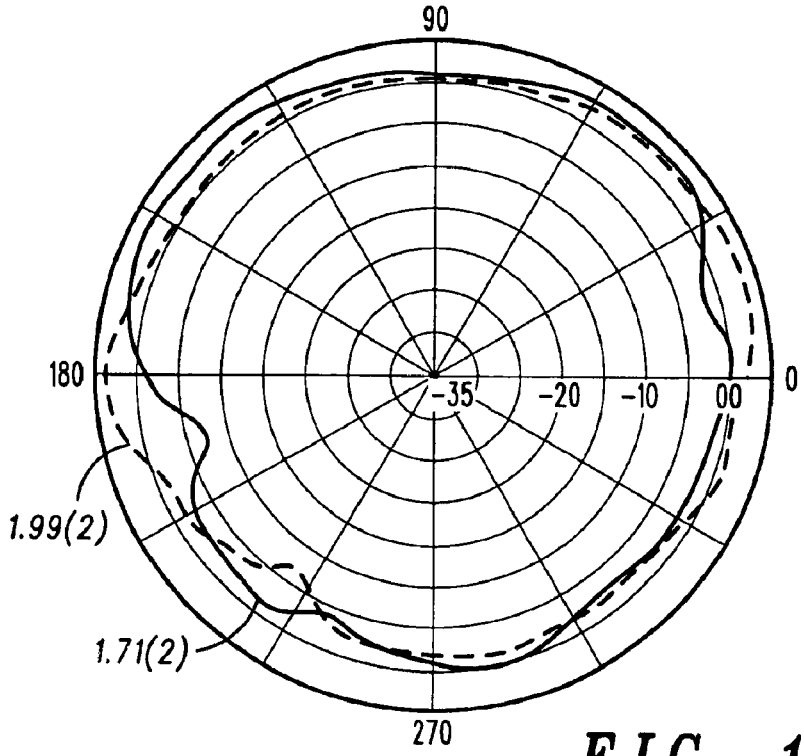
FIG. 19 is a measurement graph of actually measured RF radiation patterns obtained in azimuth cut for the handset in the orientation shown in FIG. 2 in higher frequency bands (1.71–1.99 GHz).

FIGS. 16–19 show the antenna radiation patterns actually measured for a practical device of the form shown in FIGS. 3 to 7. In FIG. 16, two curves are shown labelled 0.806(1) and 0.96(1). These represent results measured respectively at the frequencies 0.806 GHz and 0.96 GHz with the handset shown in the orientation shown in FIG. 1. In FIG. 17, two curves are shown labelled 0.806(2) and 0.96(2). These represent results measured respectively at the frequencies 0.806 GHz and 0.96 GHz with the handset shown in the orientation shown in FIG. 2. In FIG. 18, two curves are shown labelled 1.71(1) and 1.99(1). These represent results measured respectively at the frequencies 1.71 GHz and 1.99 GHz with the handset shown in the orientation shown in FIG. 1. In FIG. 19, two curves are shown labelled 1.71(2) and 1.71(2). These represent results measured respectively at the frequencies 1.71 GHz and 1.99 GHz with the handset shown in the orientation shown in FIG. 2.

The results shown in FIGS. 16–19 show that the measurement patterns obtained in practice are similar to those obtained for simulation results and that the simulation results are a good representation of how the device behaves in practice. Further measurements for radiation patterns at frequencies between those for which the results are shown in FIGS. 16–19 have been measured and show similar results to the curves of FIGS. 16–19. Gain results obtained from these radiation measurements are given in Tables 1–4 as follows.

TABLE 1

Gain with rotational position of handset as in FIG. 1

| Frequency, GHz | Peak Gain, dBi | Average Gain, dBi |
|---|---|---|
| 0.806 | −2.30 | −5.47 |
| 0.824 | −3.63 | −5.99 |
| 0.850 | −4.18 | −7.13 |
| 0.870 | −2.77 | −6.75 |
| 0.881 | −2.60 | −7.24 |
| 0.920 | −3.75 | −8.32 |
| 0.960 | −3.20 | −7.80 |

TABLE 2

| Gain with rotational position of handset as in FIG. 2. | | |
|---|---|---|
| Frequency, GHz | Peak Gain, dBi | Average Gain, dBi |
| 0.806 | 0.91 | −0.85 |
| 0.824 | 0.83 | −1.30 |
| 0.850 | −0.23 | −2.11 |
| 0.870 | 0.36 | −1.67 |
| 0.881 | 0.59 | −2.20 |
| 0.920 | −1.02 | −3.80 |
| 0.960 | 0.10 | −3.74 |

TABLE 3

| Gain with rotational position of handset as in FIG. 1 | | |
|---|---|---|
| Frequency, GHz | Peak Gain, dBi | Average gain, dBi |
| 1.71 | −2.02 | −5.85 |
| 1.78 | −1.89 | −5.58 |
| 1.86 | −1.68 | −6.44 |
| 1.92 | −2.62 | −7.10 |
| 1.99 | −1.89 | −7.81 |

TABLE 4

| Gain with rotational position of handset as in FIG. 2 | | |
|---|---|---|
| Frequency, GHz | Peak Gain, dBi | Average gain, dBi |
| 1.71 | 2.82 | −0.39 |
| 1.78 | 3.07 | 0.07 |
| 1.86 | 2.47 | −0.79 |
| 1.92 | 2.66 | −0.98 |
| 1.99 | 4.01 | 0.07 |

We claim:

1. An antenna device comprising:

a conducting base;

an elongate conducting element electromagnetically coupled to and extending from the conducting base;

a parasitic conductor electrically connected to and extending from the conducting base, wherein the conducting element and the parasitic conductor extend from the conducting base at a single corner region of the conducting base; and an insulating substrate, wherein the conducting element and the parasitic conductor are provided on opposite surfaces of the insulating substrate, wherein the conducting element, the parasitic conductor and the conducting base are mutually configured to provide conducting surfaces in which RF electrical currents can flow in a plurality of frequency bands to provide substantially omnidirectional radiation patterns in two mutually orthogonal planes.

2. An antenna device as claimed in claim 1 wherein the conducting element, the parasitic conductor and the conducting base are mutually configured to provide radiation patterns having a radiation polarization component substantially the same.

3. An antenna device as claimed in claim 1 wherein the substrate comprises a substantially planar insulating board and the conducting element and the parasitic conductor are deposited on the surfaces of the board as shaped metallic strips.

4. An antenna device as claimed in claim 1 wherein the conducting element and the parasitic conductor have lengths which in operation provide the conducting element with an electrical length about twice that of the parasitic conductor.

5. An antenna device as claimed in claim 4 wherein the conducting element comprises an elongate strip having a first portion extending along a first axis and the parasitic element comprises a shaped strip extending along the first axis toward the conducting base.

6. An antenna device as claimed in claim 5 wherein the conducting element also has a second portion extending along a second axis to provide an angled bend between the first and second portions.

7. An antenna device as claimed in claim 6 wherein the angled bend of the conducting element is substantially right angled.

8. An antenna device as claimed in claim 1 wherein the conducting element comprises a microstrip having a plurality of portions having different widths.

9. An antenna device as claimed in claim 7 wherein the conducting element comprises a microstrip having a plurality of portions having different widths.

10. An antenna device as claimed in claim 9 wherein the conducting element has a portion of greatest width at a free end of the conducting element distant from the base.

11. An antenna device as claimed in claim 3 wherein the parasitic conductor comprises a strip having a shape including on a first side an edge having a curved recess and on a second side an edge sloping toward the first side.

12. An antenna device as claimed in claim 1 wherein the base comprises a conducting block and the conducting element and the parasitic conductor extend from the block.

13. An antenna device as claimed in claim 12 wherein the conducting block has a main face substantially parallel with the conducting element and the parasitic element.

14. An antenna device as claimed in claim 1 wherein the conducting element and the parasitic element are mutually configured to provide in operation a current flow in the parasitic element in opposition to a current flow in the conducting element.

15. An antenna device as claimed in claim 13 wherein the conducting element and the parasitic element are mutually configured to provide in operation a current flow in the parasitic element in opposition to a current flow in the conducting element.

16. An antenna device as claimed in claim 12 wherein:

the device includes a substantially planar insulating board and the conducting element and the parasitic conductor are deposited on opposite surfaces of the board as shaped metallic microstrips;

the conducting element comprises an elongate microstrip having a first portion extending away from the block along a first axis, a second portion extending along a second axis perpendicular to the first axis and a right angled bend between the first and second portions; and the parasitic element comprises a shaped strip extending away from the block along the first axis and has a shape including on a first side an edge having a curved recess and on a second side an edge sloping toward the first side.

17. An antenna device as claimed in claim 16 wherein the parasitic conductor includes a tab which extends adjacent to a surface of the block.

18. An antenna device as claimed in claim 17 wherein the tab is secured to the block to provide electrical contact with the block.

19. An antenna device as claimed in claim 1 wherein the conducting base has a major surface and the antenna device further comprises at least one further conducting element electrically connected to the base and having a surface substantially orthogonal to the major surface of the base.

20. An antenna device as claimed in claim 19 wherein the at least one further conducting element comprises a platelet having a shape which approximates to a D shape having a longest dimension in a plane substantially parallel with the major surface of the base.

21. A communications handset including an antenna device, the antenna device including a conducting base, an elongate conducting element electromagnetically coupled to and extending from the conducting base, a parasitic conductor electrically connected to and extending from the conducting base, wherein the conducting element and the parasitic conductor extend from the conducting base at a single corner region of the conducting base; and an insulating substrate, wherein the conducting element and the parasitic conductor are provided on opposite surfaces of the insulating substrate wherein the conducting element, the parasitic conductor and the conducting base are mutually configured to provide conducting surfaces in which electrical currents can flow at radio frequency (RF) in a plurality of frequency bands to provide omnidirectional radiation patterns in two mutually orthogonal planes for same polarization signal.

22. A handset as claimed in claim 21 wherein the handset is operable in a GPRS communication system.

* * * * *